US010448722B2

(12) United States Patent
McLuckie

(10) Patent No.: US 10,448,722 B2
(45) Date of Patent: Oct. 22, 2019

(54) SUPPORT FOR A HAIR CARE APPLIANCE

(71) Applicant: Dyson Technology Limited, Wiltshire (GB)

(72) Inventor: Paul Andrew McLuckie, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 15/927,630

(22) Filed: Mar. 21, 2018

(65) Prior Publication Data

US 2018/0271250 A1 Sep. 27, 2018

(30) Foreign Application Priority Data

Mar. 22, 2017 (GB) ..... 1704524.6

(51) Int. Cl.
*F16M 11/00* (2006.01)
*A45D 20/14* (2006.01)
*A45D 20/12* (2006.01)

(52) U.S. Cl.
CPC ..... *A45D 20/14* (2013.01); *A45D 20/12* (2013.01); *A45D 20/122* (2013.01); *A45D 2020/126* (2013.01)

(58) Field of Classification Search
CPC ..... F16B 2001/0035; Y10S 211/01; Y10S 206/818; Y10S 428/90
USPC ..... 248/105, 311.3, 206.5
See application file for complete search history.

(56) References Cited

U.S. PATENT DOCUMENTS 3,860,048 A * 1/1975 White ..... B67C 9/00 141/375
4,219,178 A 8/1980 Assion
4,278,225 A * 7/1981 Phelps ..... A61J 1/06 248/311.3
4,333,623 A * 6/1982 May ..... B05C 17/00523 248/117.2
4,673,148 A * 6/1987 Oliver ..... A45D 20/12 248/292.14
4,696,447 A 9/1987 Strecker
(Continued)

FOREIGN PATENT DOCUMENTS

BR MU 8303358-0 7/2005
CH 419 480 3/1967
(Continued)

OTHER PUBLICATIONS

Search Report dated Jul. 6, 2017, directed to GB Application No. 1704524.6; 2 pages.
(Continued)

*Primary Examiner* — Steven M Marsh
(74) *Attorney, Agent, or Firm* — Morrison & Foerster LLP

(57) ABSTRACT

A support for a hair care appliance, the support comprising a first storage position and at least one further storage position, wherein the first storage position is configured to connect the hair care appliance to the support and the at least one further storage position is configured to connect at least one attachment for changing a property of fluid exiting from the appliance to the support. The support may include a stand portion and a base portion wherein the base portion is designed to sit atop a surface and the stand portion extends from the base portion and includes the first storage position and the at least one further storage position.

14 Claims, 8 Drawing Sheets

(56) References Cited

U.S. PATENT DOCUMENTS

| | | | | |
|---|---|---|---|---|
| 4,735,002 | A | 4/1988 | Rath | |
| 5,054,615 | A | 10/1991 | Stillwagon et al. | |
| 5,590,475 | A | 1/1997 | Andis | |
| 5,615,782 | A | 4/1997 | Choe | |
| 5,630,517 | A | 5/1997 | Maznik | |
| 5,669,516 | A * | 9/1997 | Horn | B25H 3/06 206/350 |
| 5,947,432 | A | 9/1999 | Reddin et al. | |
| 6,006,906 | A * | 12/1999 | Winnard | B25H 3/06 206/350 |
| 6,592,091 | B1 | 7/2003 | Michaels | |
| 7,748,583 | B1 | 7/2010 | Woltman | |
| 7,798,336 | B2 * | 9/2010 | Shiao | B25H 3/04 211/70.6 |
| 8,869,996 | B1 | 10/2014 | Christenson | |
| 2002/0043003 | A1 | 4/2002 | Cruz | |
| 2005/0091867 | A1 | 5/2005 | Andis et al. | |
| 2005/0224666 | A1 | 10/2005 | Lin et al. | |
| 2006/0289367 | A1 | 12/2006 | Cossey | |
| 2009/0184077 | A1 | 7/2009 | Curet et al. | |
| 2013/0037501 | A1 | 2/2013 | Schmidt et al. | |
| 2016/0353854 | A1 | 12/2016 | Thomas | |

FOREIGN PATENT DOCUMENTS

| | | |
|---|---|---|
| CH | 569 444 | 11/1975 |
| CN | 2226861 | 5/1996 |
| CN | 2322455 | 6/1999 |
| DE | 943 431 | 5/1956 |
| DE | 1 557 303 | 8/1969 |
| DE | 7242786 | 3/1973 |
| DE | 295 11 125 | 10/1995 |
| DE | 297 14 342 | 9/1997 |
| DE | 201 02 172 | 6/2001 |
| DE | 10 2007 047 069 | 4/2009 |
| EP | 2 520 191 | 11/2012 |
| ES | 242294 | 3/1979 |
| FR | 2 250 270 | 5/1975 |
| GB | 1 391 397 | 4/1975 |
| GB | 2 275 862 | 9/1994 |
| JP | 55-60806 | 10/1978 |
| JP | 59-136703 | 9/1984 |
| JP | 60-53203 | 4/1985 |
| JP | 60-182914 | 12/1985 |
| JP | 61-244306 | 10/1986 |
| JP | 63-5901 | 1/1988 |
| JP | 63-37103 | 3/1988 |
| JP | 63-111803 | 7/1988 |
| JP | 1-37523 | 11/1989 |
| JP | 1-314504 | 12/1989 |
| JP | 5-184421 | 7/1993 |
| JP | 2004-329482 | 11/2004 |
| JP | 3154684 | 10/2009 |
| JP | 4377496 | 12/2009 |
| JP | 2010-75248 | 4/2010 |

OTHER PUBLICATIONS

International Search Report and Written Opinien dated Jun. 8, 2018, directed to International Application No. PCT/GB2018/050587; 12 pages.

* cited by examiner

SUPPORT FOR A HAIR CARE APPLIANCE

REFERENCE TO RELATED APPLICATIONS

This application claims the priority of United Kingdom Application No. 1704524.6, filed Mar. 22, 2017, the entire contents of which are incorporated herein by reference.

FIELD OF THE INVENTION

This invention relates to a support for a hair care appliance and in particular a hairdryer and especially a hairdryer having interchangeable attachments.

BACKGROUND OF THE INVENTION

Some users of hair care appliances will place the product onto a surface whilst it is running for example to select a new tress of hair. This is not a problem for appliances that are without fluid flowing such as straighteners however, where there is fluid flow, the product may not remain where placed and could potentially be damaged or cause damage. Conventionally, hairdryers will be provided with a hanging loop extending from adjacent a strain relief from which it can be hung from a hook. An alternative is to provide a hoop into which the body is inserted when not in use.

A problem with these methods of storing are that they only provide storage for the appliance and one attachment, if it is attached to the hairdryer, any other attachments must be stored elsewhere and could get misplaced or even lost. Another problem is that if users store the appliance whilst it is running the appliance is likely to move around and again cause damage or be damaged. One solution to both these problems is to magnetically attract the hairdryer to a storage location via a metal outlet grille however the proposed solutions such as is disclosed in Japanese Patent Application Number JP55060806 do not provide for storage of attachments or for allowing the appliance to run whilst being stored.

SUMMARY OF THE INVENTION

According to some embodiments, a support for a hair care appliance is provided in which the appliance is located in a known and fixed position where the device includes a fluid outlet so if the appliance is located with respect to the stand whilst running fluid exiting from the appliance is in fluid communication with the fluid outlet of the device.

According to some embodiments, a support for a hair care appliance is provided in which both the appliance and at least one attachment can be attached to or stored on the support.

According to a first aspect, a support for a hair care appliance comprises a stand portion comprising an aperture that extends through the stand portion and a collar extending around the aperture wherein the collar is adapted to retain an appliance with respect to the aperture so that fluid exiting the appliance is in fluid communication with the aperture of stand portion.

Preferably, the stand portion comprises a first side and a second side wherein the first side is adapted to receive and retain the appliance.

It is preferred that the collar at least partially defines an inner periphery of the aperture.

Preferably, the collar comprises a first ring which at least partially defines the inner periphery of the aperture.

It is preferred that the collar comprises a second ring disposed radially inwards of the first ring.

Preferably, the second ring is connected to the first ring by connection struts extending radially between the first ring and the second ring.

It is preferred that the connection struts are a series of spaced apart ribs that connect between the first ring and the second ring wherein between each adjacent pair of connection struts a thorough hole is provided through the support.

Preferably, the second ring comprises an upstanding portion which extends orthogonally away from the first surface of the stand portion.

It is preferred that the upstanding portion is adapted to retain the appliance with respect to the aperture.

Preferably, one or more of the aperture and the through holes is in fluid communication with the fluid outlet from an appliance when the appliance is connected to the support.

It is preferred that the collar is made from a non-conducting material.

Preferably, the collar further comprises a plurality of magnets or discrete regions of magnetic material radially spaced around the collar.

It is preferred that the plurality of magnets or discrete regions of magnetic material are recessed within the collar.

Preferably, the plurality of magnets or discrete regions of magnetic material retain an appliance with respect to the aperture.

According to a second aspect, t a hair care appliance and a support for the appliance are provided, the appliance comprising a primary fluid flow path extending from a primary fluid inlet into the appliance to a primary fluid outlet from the appliance and a fluid flow path extending from a fluid inlet into the appliance to a fluid outlet from the appliance and the support comprising a stand portion comprising an aperture that extends through the stand portion and a collar extending around the aperture wherein the collar is adapted to retain an appliance with respect to the aperture so that fluid exiting from the fluid outlet of the appliance is in fluid communication with the aperture of the stand portion.

Preferably, the collar comprises at least one further aperture wherein the at least one further aperture is in fluid communication with the primary fluid outlet from the appliance.

According to a third aspect, a support for a hair care appliance comprises a first storage position and at least one further storage position and the hair care appliance comprising an appliance and at least one attachment for changing a property of fluid exiting from the appliance wherein the first storage position is adapted to connect the hair care appliance to the support and the at least one further storage position is adapted to connect the at least one attachment to the support.

Preferably, the support comprises a stand portion and a base portion wherein the base portion is designed to sit atop a surface and the stand portion extends from the base portion and comprises the first storage position and the at least one further storage position.

It is preferred that the at least one further storage position comprises a second storage position and a third storage position.

Preferably, the third storage position is provided on the stand portion.

It is preferred that the support comprises a base portion designed to sit atop a surface and another storage position is provided on the base portion.

Preferably, the appliance and the at least one attachment are attached to the support via magnetic attraction.

It is preferred that the appliance is attached to the support by a mechanical fixture.

Preferably, the support is portable.

BRIEF DESCRIPTION OF THE DRAWINGS

The invention will now be described in detail and with reference to the accompanying drawings, of which.

DETAILED DESCRIPTION OF THE INVENTION

Figure 1:
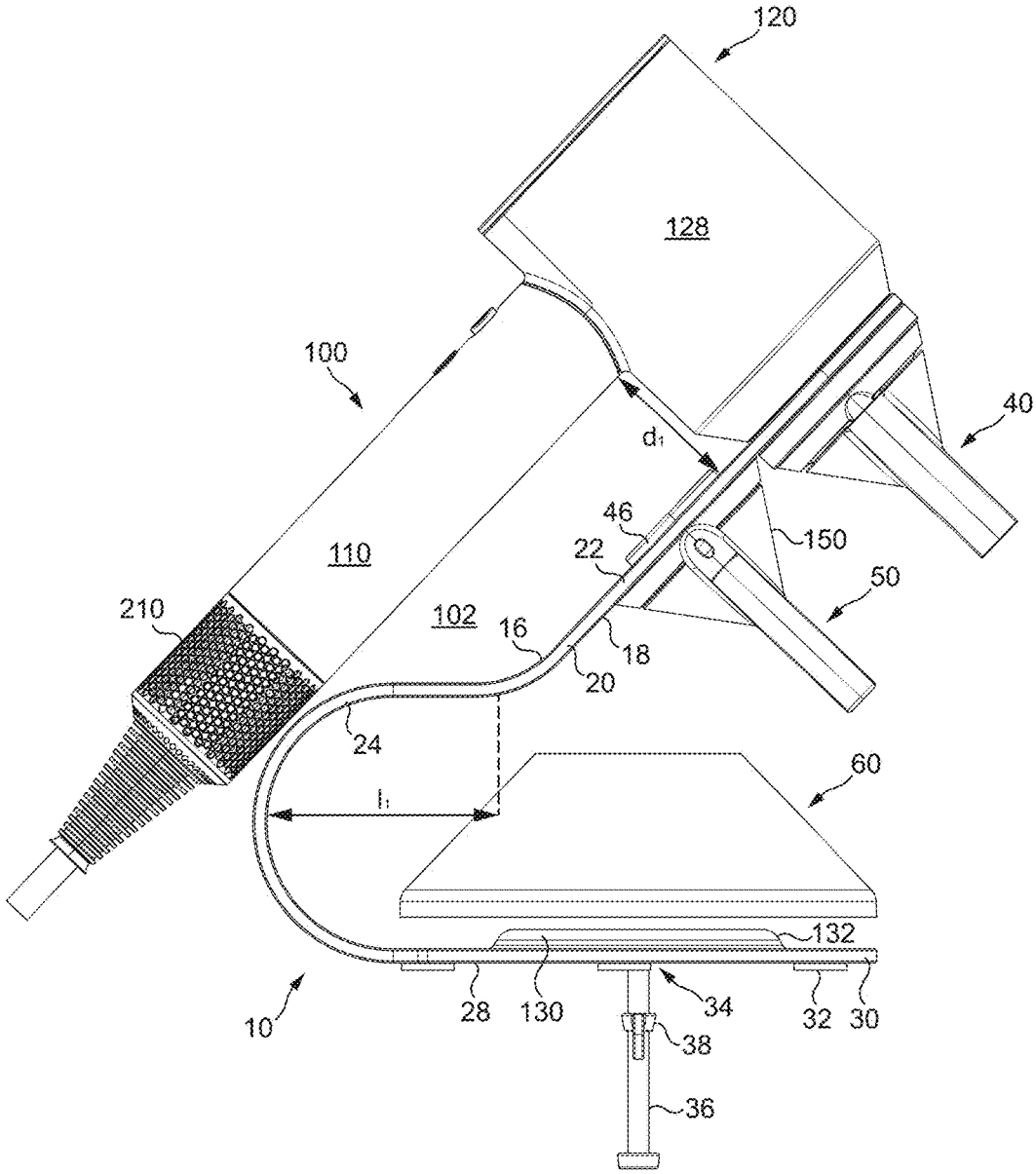
FIG. 1 shows a side view of a support with a hair care appliance and attachments attached to the support.
Figure 2:
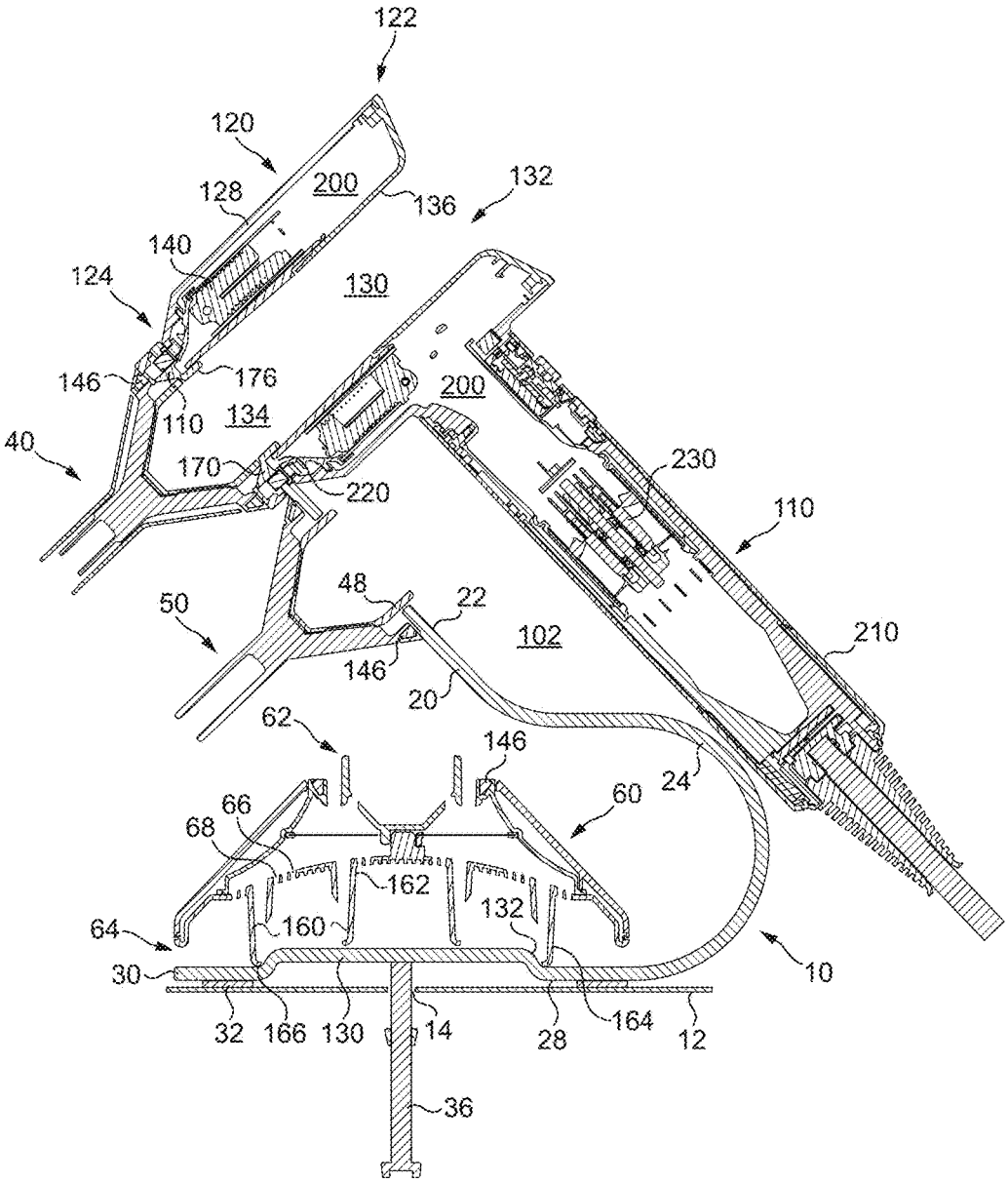
FIG. 2 shows a cross section through the side view of FIG. 1.
Figure 3:
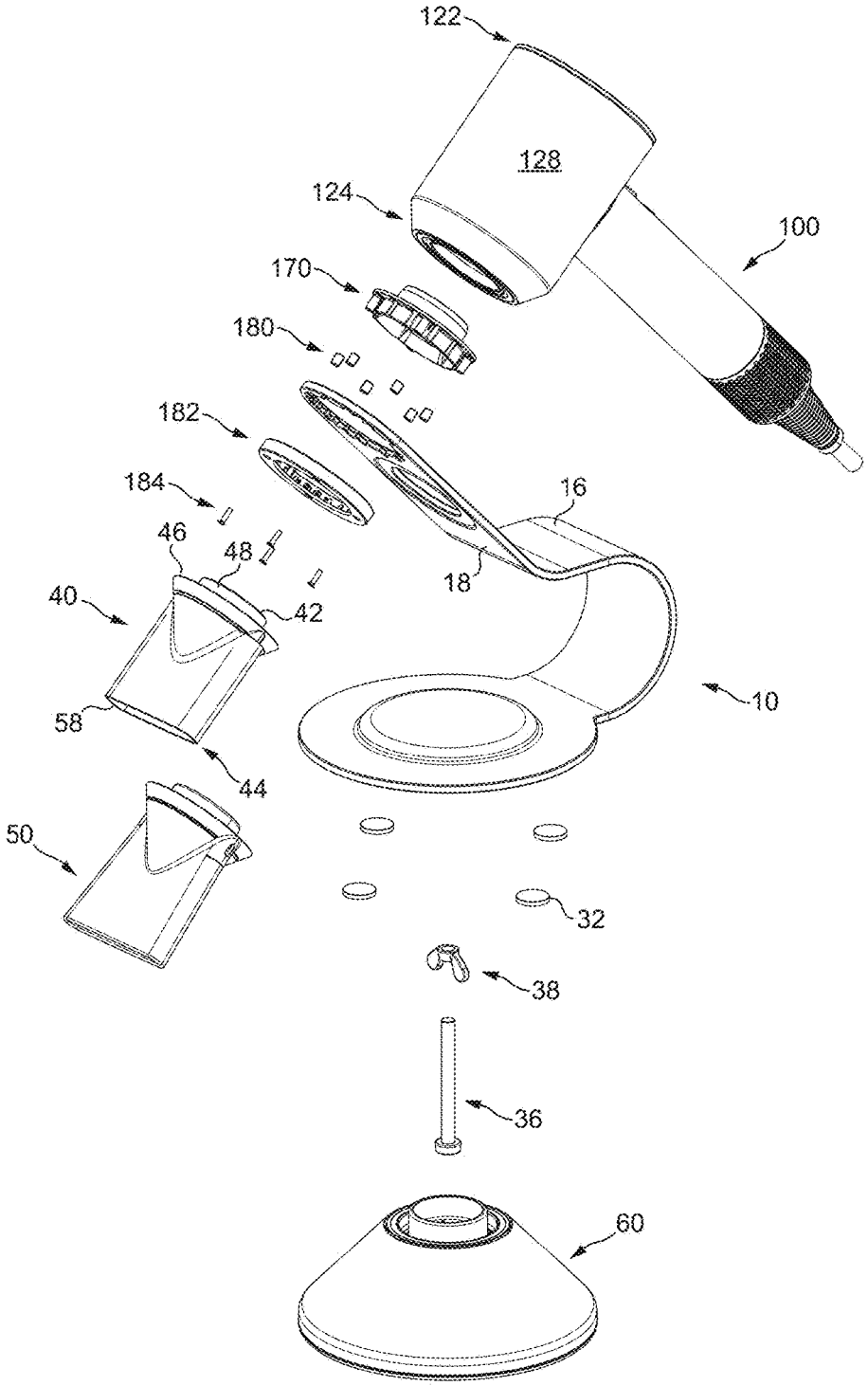
FIG. 3 shows an exploded isometric view of the support shown in FIG. 1.
Figure 4B:
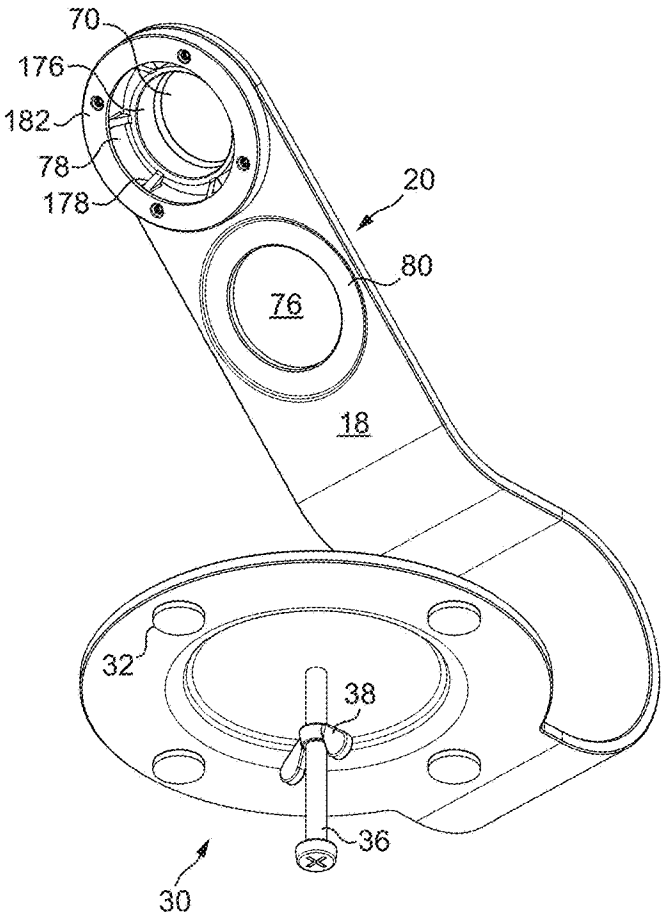
FIGS. 4*a* and 4*b* show rear and front isometric views of the support.
Figure 4A:
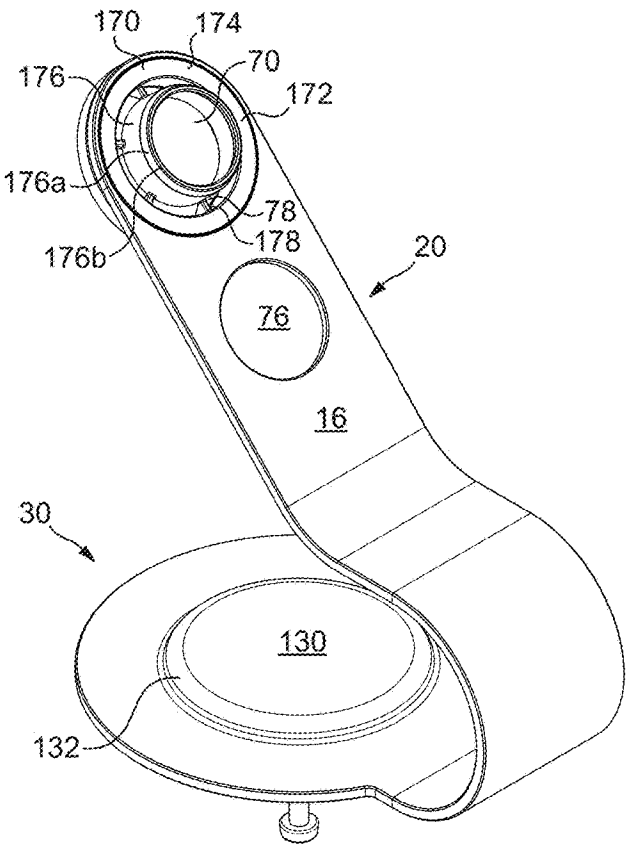
Figure 4C:
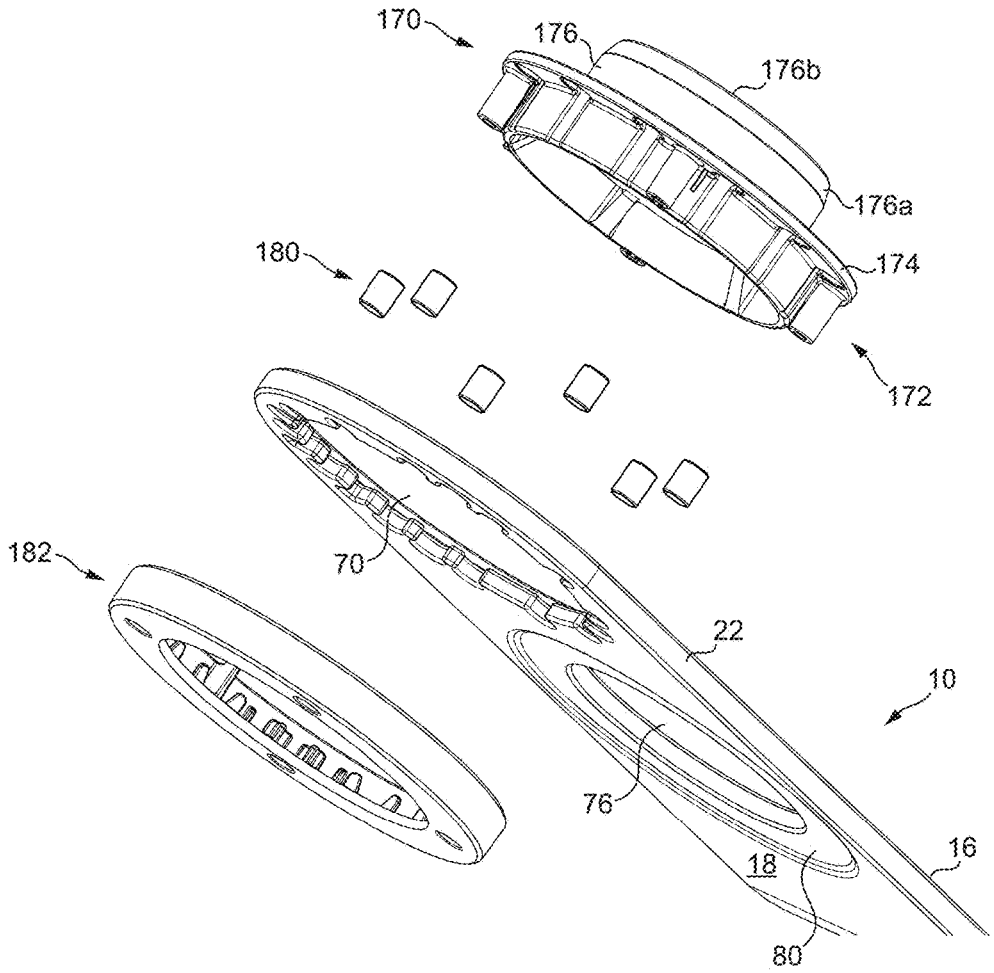
FIG. 4*c* shows a partial isometric exploded view of part of the support and the collar.
Figure 4D:
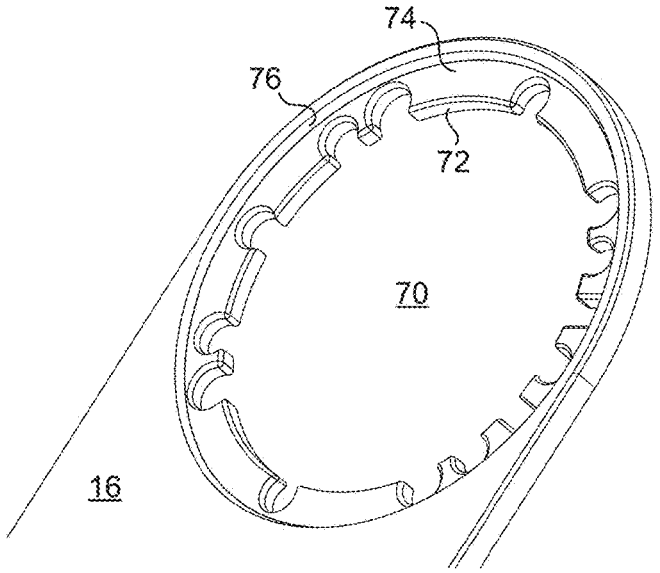
FIG. 4*d* shows a partial isometric view of part of the support.

FIG. 1 shows a support 10 on which a hairdryer 100 is stored. Referring in addition to FIGS. 2, 4*a* and 4*b*, the support 10 has a stand portion 20 and a base portion 30. The base portion 30 is adapted to be placed on a flat surface and includes a surface engaging part 28 having cushioning feet 32 to prevent inadvertent movement and scratching of the surface 12 on which the support 10 is placed. In addition, the base portion 30 includes a screw boss 34, into which a screw 36 can be inserted. This enables the base portion 30 to be securely attached to a surface 12 via a hole 14 through the surface 12, then a combination of the screw 36 and a wing nut 38 attached to the screw fastens the base portion 30 with respect to the surface 12.

The support 10 has two functions. A first function is to provide a repeatable positioning for a hair care appliance 100 when the appliance is attached to the support 10. A second function is to provide storage locations for a number of attachments 40, 50, 60 intended to be used with the appliance 100. In this example there are three attachments 40, 50, 60. Each providing a slightly different functionality to the appliance 100 when attached.

To briefly introduce the appliance 100, it has a handle 110 and a body 120. The body 120 includes a fluid flow path 130 extending from a fluid inlet 132 into the body to a fluid outlet 134 from the body. The fluid flow path 132 is defined by a wall 136, which in this embodiment is tubular, that extends from the fluid inlet 132 to the fluid outlet 134.

The body 120 has an inlet end 122 which includes the fluid inlet 132 and an outlet end 124 which includes the fluid outlet 134. The support 10 is adapted to retain the appliance 100 at the outlet end 124 of the body 120. The handle 110 is connected to the body 130 a distance away from the outlet end 124 of the body 120.

The appliance 100 has another fluid flow path, a primary fluid flow path 200 which extends from a primary fluid inlet 210 provided in the handle 110 of the appliance 100 to a primary fluid outlet 220 at the outlet end 124 of the body 120. Fluid in the primary fluid flow path 200 is drawn into the primary fluid inlet 210 by the action of a fan unit 230 located in the handle 110. The primary fluid flow path 200 extends around an external periphery of the wall 136 and is defined by the wall 136 and an outer wall 128. Inbetween the wall 136 and the outer wall 128 a heater 140 is provided. The heater 140 optionally heats the fluid flowing through the primary fluid flow path 200.

Referring now to the support 10, the base portion 30 of the support 30 houses a third one of the attachments 60. This third attachment 60 is a diffuser and is designed to slow down the flow that exits the appliance 10. Consequently, it is a relatively large and conical to provide a plenum for the fluid that flows into the diffuser from the appliance 100.

Figure 5:
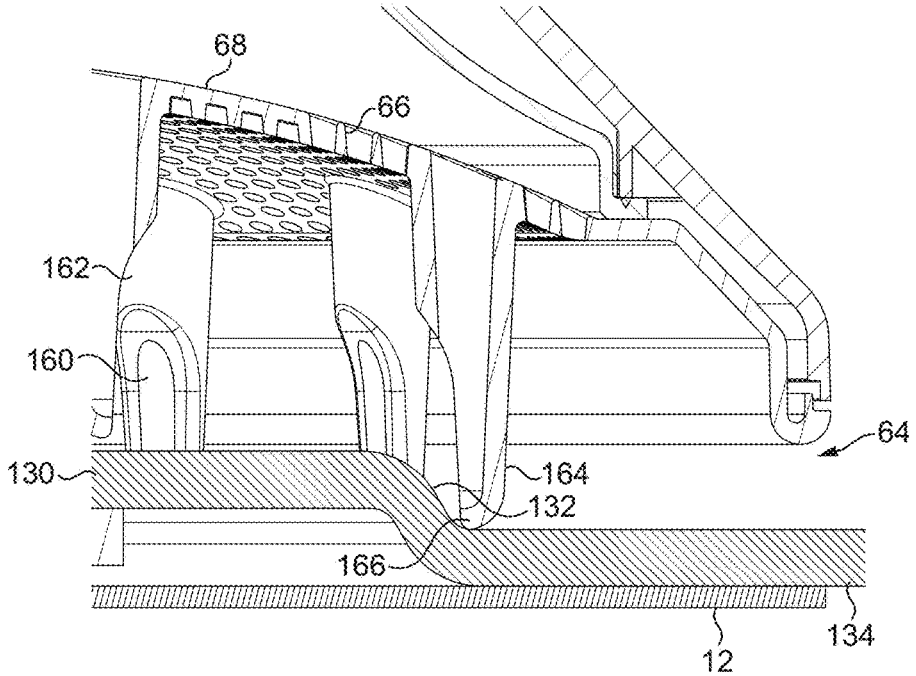
FIG. 5 shows an enlarged partial side view of the diffuser of FIG. 2.

Referring to FIGS. 2 and 5, the diffuser includes an inlet end 62 and an outlet end 64 and the inlet end 62 is adapted to attach to the appliance 100. The outlet end 64 contains two types of aperture. A first type of aperture 66 is provided in a grille 68 which extends across the cross section of the outlet end 64. A second type of aperture 160 is provided along prongs 162 which extend out from the grille 68. The prongs 162 are arranged in rings and an outer ring 164 extends further from the inlet end 62 than any other part of the diffuser.

The base portion 30 is adapted to engage with the outer ring 164 to attach the third attachment 60 to the support 10. The base portion 30 is generally flat so it rests on a surface 12, but it is provided with a raised circular section 130 which receives the third attachment 60. The raised circular section 130 is of a diameter that the side 132 that forms the transition between the raised circular section 130 and the surface engaging part 28 has a smaller diameter than the outer ring 64 and holds an end face 166 of the outer ring 164 in place with respect to the support 10.

The stand portion 20 has two sections a first portion 22 which is generally planar and a second portion 24 which extends between the base portion 30 and the first section 22 of the stand portion 20. The first portion 22 is used to retain the appliance 100. The second portion 24 provides the transition from the base portion 30 to the first portion 22 of the stand portion 20. The nominal angle between the base portion 30 and the first portion 22 is around 45° however, as the skilled person will appreciate any angle of between about 30° and 60° could be feasible dependent on the weight of the base portion 30, the height of the first portion and the weight of the appliance 10 plus all the attachments 40, 50, 60.

In this embodiment, the second portion 24 does not merely provide a simple transformation from the base portion 30 to the first portion 22. This is partly due to the room required to accommodate the third attachment 60. It is also so that the second portion 24 can support a part of the appliance 100 is a manner in which a user can easily grab the appliance 100 to remove it from the support 10.

The support has a first side 16 and a second side 18. The support 10 receives the appliance 100 at the first side 16. The first portion 22 of the stand portion 20 is provided with an aperture 70 which is used to retain the wall 136 of the body 120. The handle 110 extends generally orthogonally from the body 120, so when the wall 136 is retained with respect to the aperture 70, by a user placing the appliance 100 onto the support 10, the handle 110 extends along the stand portion 20 from the first portion 22 towards the second portion 24. Thus, the second portion 24 can support the handle 110 of the appliance 100.

The second portion 24 is generally U-shaped extending from the base portion 30 around a semi-circular path to engage with the first portion 22. The length l1 of a side 122 of the second portion 24 matches the distance d1 between the outlet end 124 of the body 120 and the handle 110. This means that a space 102 is provided between the first side 16 of the support 10 and the handle 110 which enables a user to grip and hold the appliance 100 before removing the appliance 100 from the support 10.

In order to repeatedly position the appliance 100 with respect to the stand portion 20, the aperture 70 is provided with a collar 170 which extends around the aperture 70 and engages with the outlet end 124 of the appliance 100. The aperture 70 is defined by a surface 72 and, on the first side 16 of the support 10, and adjacent the surface 72 is a recessed rim 74 and outer edge 76 of the recessed rim 74 engages with a flange 174 of the collar 170.

Specifically, the collar 170 has a first ring 172 which engages with the surface 72 of the aperture 70, a flange 174 which extends radially out from the first ring 172 and engages with the recessed rim 74 of the stand 10 and a second ring 176. The second ring 176 is located radially inwards of the first ring 172 and is connected to the first ring 172 via struts 178 that extend between the first ring 172 and the second ring 176 and are radially spaced around the circumference of both the first ring 172 and the second ring 176. In between adjacent struts 178 are further apertures 78.

The second ring 176 protrudes from the first surface 16 of the support 10 and includes an upstanding portion **176*a* which extends orthogonally away from the first surface 16 of the support 10. The upstanding portion 176*a* engages with the outlet end 124 of the appliance 100. Specifically, the upstanding portion 176*a* extends with the wall 136 of the appliance 100 when it is attached to the stand portion 20. The upstanding portion 176*a* extends around and within the wall 136**.

Figure 6:
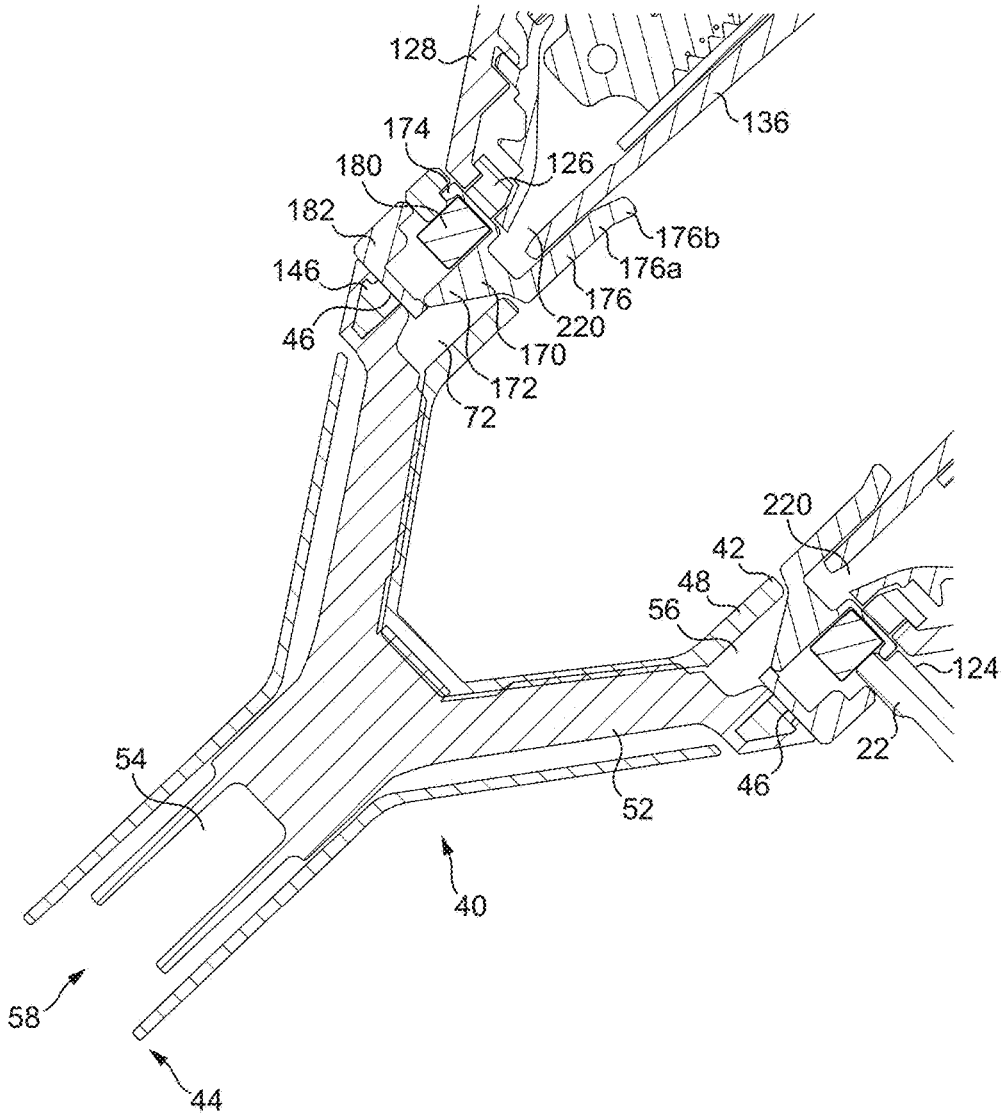
FIG. 6 shows an enlarged partial side view of the support and appliance shown in FIG. 2.
Figure 7A:
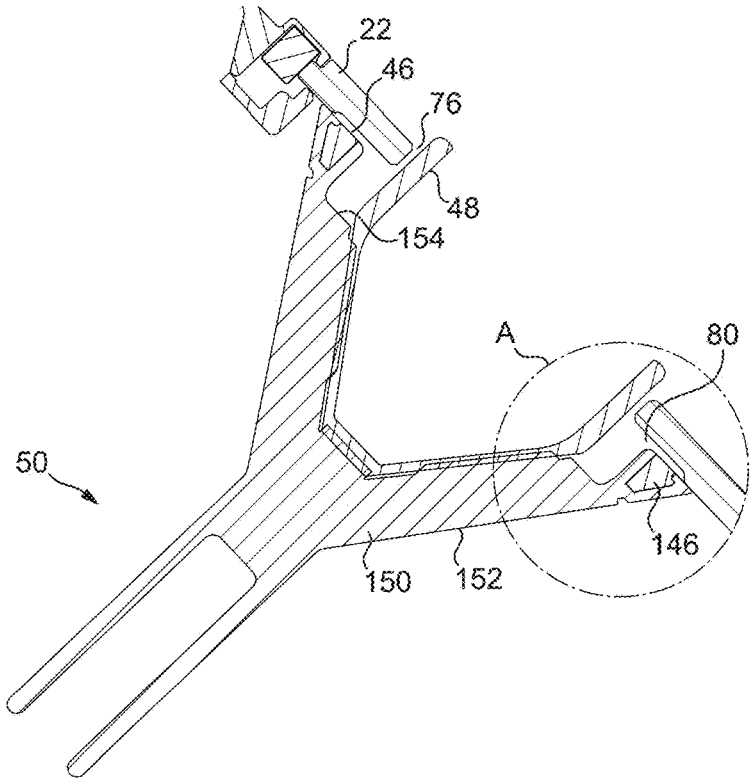
FIG. 7*a* shows an enlarged partial side view of the stand portion or the support.
Figure 7B:
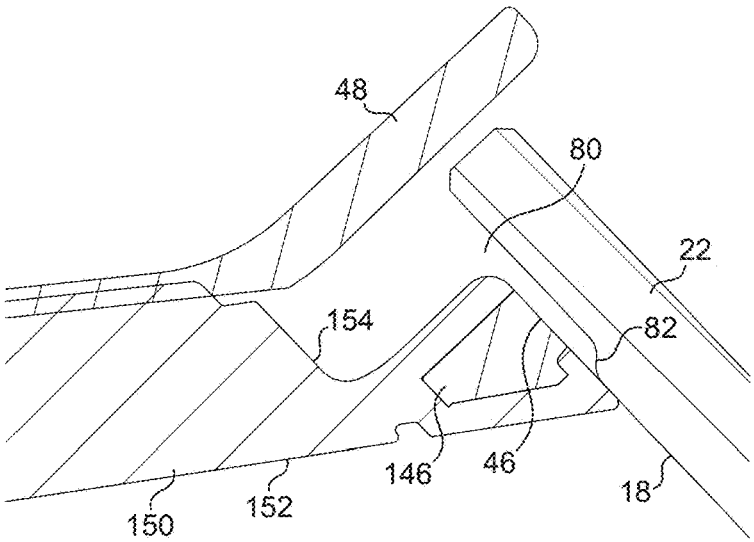
FIG. 7*b* shows an enlarged view of portion A of FIG. 7*a*.

In some embodiments, at a distal end **176*b* of the upstanding portion 176*a* from the first side 16 of the support 10 the upstanding portion tapers radially inwards. This assists in locating the appliance 100 on the support 10. This additional and non-essential feature is shown with respect to FIGS. 4*a* and 6**.

In this embodiment, in order to assist with the retention of the appliance 100 on the stand portion 20, both the appliance 100 and the stand portion 20 are provided with magnets or magnetised material so that in addition to the mechanical interaction, magnetic attraction is also utilised. The appliance 100 includes a metal ring 126, for example a steel ring, located adjacent the outlet end 124 and the stand portion 20 includes a plurality of radially spaced apart magnets 180. Both the upstanding portion **176*a* and the magnetic attraction are used to provide repeatable location of the appliance 100 on the stand portion 20**.

At the outlet end 124 of the appliance 100, the outer wall 128 is the radially outermost part of the body 120, moving radially inwards towards the centre of the body 120 is the metal ring 126, the primary fluid outlet 220, the wall 136 and finally the fluid flow path 130. When the appliance 100 is attached to the support 10, the metal ring 126 aligns with the magnets 180 with the flange 174 inbetween, the upstanding portion **176*a* is inserted within the wall 136 and the primary fluid outlet 220 aligns with the further apertures 74**.

The provision of the further apertures 74 along with the alignment of the appliance 100 with the collar 170 ensures that in the event that the appliance 100 is placed on the support 10 whilst it is in operation, the fluid that flows through the primary fluid flow path 200 can exit through the support 10 via the further apertures 78.

The collar 170 and the magnets 180 can be glued to the first portion 22 of the stand portion 20 or another mechanical fixing technique can be used.

In order to assist with one of the functions of the stand portion 20 and to provide an additional storage position for a first attachment 40 suitable for use with the appliance 100, a second collar 182 is provided. The second collar 182 is positioned adjacent the second side 18 of the support 10 and could again be glued to the first portion 22 of the stand 20. In this embodiment, alternatively or additionally, the second collar 182 is screwed to the first collar 170 via four screws 184 effectively sandwiching the first portion 22 of the stand portion 20 and the magnets 180 between them.

The second collar 182 is a simple ring which extends around the aperture 70 on the second side 18 of the first portion 22 of the stand portion 20.

The first attachment 40 has an inlet end 42 and an outlet end 44. The inlet end 42 includes an end face 46 and is adapted to engage with the outlet end 124 of the appliance. The end face 46 or an adjacent area also contain magnets or magnetised material 146. When any of the attachments 40, 50, 60 is attached to the appliance 100, the magnets or magnetised material 146 at or adjacent the end face 46 in any of the attachments 40, 50, 60 is attracted to the ring of metal 126 provided at the outlet end 124 of the appliance 10. The first attachment 40 includes an inner wall 48 which is adapted to engage with the wall 136 of the body 120 of the appliance 100. This serves two functions, firstly it assists with the positioning of the first attachment 40 with respect to the appliance 100 and secondly it blocks the flow of fluid through the fluid flow path 130. The first attachment 40 includes a second wall 52 which together with the inner wall 48 defines an attachment fluid flow path 54. The attachment fluid flow path 54 has an attachment fluid inlet 56 and an attachment fluid outlet 58. When the first attachment 40 is attached to the appliance 100, the attachment fluid inlet 56 is in fluid communication with the primary fluid outlet 220. Any fluid flowing from the primary fluid outlet 220 enters the attachment fluid flow path 54.

As the inner wall 48 is inserted into the wall 136 and the end face 44 abuts against the outlet end 124 of the appliance 100, the inner wall 48 defines the inlet end 42 of the first attachment 40. Due to this, when the first attachment 40 is retained on the support 10, the inner wall 48 extends into the aperture 70. In order to accommodate this, the collar 172 includes a recess 72 adjacent the first side 16 of the support 10.

When the first attachment 40 is connected to the support 10, the magnets or magnetised material 146 at or adjacent end face 46 aligns with the magnets 180 with the second collar 182 inbetween, the inner wall 48 extends within the aperture 70 and is accommodated within a recess 72 provided in the collar 170 and the primary fluid outlet 220 aligns with the further apertures 74.

A second attachment 50 can be accommodated on the support 10. On the first portion 22 of the stand portion 20 a second aperture 76 is provided. The second aperture 76 is sized to accommodate the inner wall 48 of the second attachment 50 (note the inner wall 48 for all attachments 40, 50, 60 are identical as they all are designed to fit with the wall 136 of the appliance 100). In this embodiment, the stand portion 20 and base portion 24 are formed from a single sheet of steel so the second attachment 50 can be attached directly to the first portion 22 with the inner wall 48 extending at least partially through the second aperture 76.

In order to enable easy removal of the second attachment 50, the end face 46 does not sit flush against the first portion 22 of the stand portion 20. The second attachment 50 has an inner wall 48 which extends through the second recess 76 and an outer wall 150 which includes end face 46 and the magnets or magnetised material 146. The outer wall 150 has an inner face 152 and an outer face 154. Adjacent the second aperture 76 the second surface 18 is provided with a further recess 80 which extends around the circumference of the second aperture 76. This further recess 80 extends radially out from the second recess 80 for a distance that allows a portion of the end face 46 to rest against the second surface 18. Thus, the second recess 80 extends radially outwards for a distance such that only a portion of the outer wall 150 of the second attachment 50 when attached to the support 10 is physically touching the second surface 18. An outer circumference 82 of the second recess 80 lies between the inner face 152 and the outer face 154 of the outer wall 150.

Alternatively, if the stand portion 20 and base portion 24 are formed from a non-ferromagnetic material, a further collar housing magnets could be used to enable attachment of the second attachment.

As the skilled addressee will appreciate, the first and second attachments are interchangeable with respect to their positions on the support 10. The third attachment may also be located in the positions described with respect to the first and/or second attachments. Additionally if the appliance 100 is not being stored an attachment 40, 50, 60 can be positioned with respect to the second aperture 76 on the first side 16 of the first portion 22 of the stand portion 20.

Whilst all the attachments 40, 50, 60 have been described as having an inner wall 48, this is not essential to the invention. Removal of the inner wall 48 means that fluid can flow through not only the primary fluid flow path 200 but also through the fluid flow path 130 when the attachment is attached to the appliance 100.

Whilst the invention has been described with respect to a hairdryer, the invention is applicable to any appliance that draws in a fluid and directs the outflow of that fluid from the appliance.

The appliance can be used with or without a heater; the action of the outflow of fluid at high velocity has a drying effect.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art.

The invention claimed is:

1. A support for supporting a hair care appliance, the support comprising:

a base portion that is configured to sit atop a surface;

a stand portion that extends upwardly from the base portion, a first side of the stand portion facing a first direction and a second side of the stand portion facing a second direction that is opposite the first direction;

a first storage position located on the first side of the stand portion; and at least one further storage position located on the second side of the stand portion, wherein the first storage position is configured for connecting the hair care appliance to the support and the at least one further storage position is configured for connecting at least one attachment for changing a property of fluid exiting from the appliance to the support so that the at least one attachment can be stored on the second side of the stand portion, and wherein the support is configured so that the appliance and the at least one attachment are attachable to the support via magnetic attraction.

2. The support of claim 1, wherein the at least one further storage position comprises a second storage position and a third storage position.

3. The support of claim 2, wherein the third storage position is provided on the stand portion.

4. The support of claim 1, wherein the base portion comprises another storage position.

5. The support of claim 1, wherein the support is configured such that the appliance is attachable to the support by a mechanical fixture.

6. The support of claim 1, wherein the support is portable.

7. The support of claim 1, wherein, when the base sits atop a surface during use, the first side is upwardly facing and the second side is downwardly facing.

8. The support of claim 7, wherein the first storage position and the second storage position are aligned.

9. A support for supporting a hair care appliance, the support comprising:

a base portion that is configured to sit atop a surface during use;

a stand portion that extends upwardly from the base portion;

a first storage position located on the stand portion; and a second storage position located on the stand portion, wherein the first storage position is configured for connecting the hair care appliance to the support and the second storage position is configured for connecting an attachment for changing a property of fluid exiting from the appliance to the support, wherein the support is configured so that the appliance and the attachment are attachable to the support via magnetic attraction, and wherein, when the base portion sits atop the surface during use, the second storage position is located between the first storage position and the surface so that when the appliance is connected to the support at the first storage position and the attachment is connected to the support at the second storage position, the attachment is located between the hair care appliance and the surface.

10. The support of claim 9, comprising a third storage position for connecting an attachment, the third storage position being located on the stand portion below the first and second storage positions.

11. The support of claim 9, wherein the support is configured so that, when the base portion sits atop the surface during use and the attachment is connected to the support at the second storage position, the attachment is suspended above the surface via magnetic attraction.

12. A support for supporting a hair care appliance, the support comprising:

a base portion that is configured to sit atop a surface during use;

a stand portion configured so that when the base portion sits atop the surface during use, a first portion of the stand portion extends outwardly from the base portion and a second portion of the stand portion extends upwardly and directly over the base portion so that the second portion overhangs at least a portion of the base;

a first storage position located on the stand portion; and at least one further storage position located on the stand portion, wherein the first storage position is configured for connecting the hair care appliance to the support and the at least one further storage position is configured for connecting at least one attachment for changing a property of fluid exiting from the appliance to the support, and wherein the support is configured so that the appliance and the at least one attachment are attachable to the support via magnetic attraction.

13. The support of claim 12, wherein the first portion of the stand portion curves backwardly toward the base portion.

14. The support of claim 12, wherein the second portion of the stand portion is angled with respect to the base portion.

* * * * *